US006447229B1

(12) United States Patent
Schlough

(10) Patent No.: US 6,447,229 B1
(45) Date of Patent: Sep. 10, 2002

(54) DEVICE AND METHOD FOR PREPARING A BOOK SPINE FOR BINDING

(75) Inventor: James Richard Schlough, Troy, OH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/570,203

(22) Filed: May 12, 2000

(51) Int. Cl.[7] ..... B42B 9/00

(52) U.S. Cl. ..... 412/1; 270/58.08; 270/52.2; 412/8; 412/33

(58) Field of Search ..... 270/58.07, 52.08, 270/52.2, 52.18, 58.08; 271/287, 292, 294; 412/1, 6, 8, 9, 33, 37

(56) References Cited

U.S. PATENT DOCUMENTS

| | | | | | |
|---|---|---|---|---|---|
| 4,124,203 | A | * | 11/1978 | Muller | 270/55 |
| 4,133,521 | A | * | 1/1979 | Muller | 270/55 |
| 4,556,353 | A | | 12/1985 | Ehlermann | |
| 4,925,354 | A | | 5/1990 | Cote | 412/8 |
| 4,988,086 | A | | 1/1991 | Schlough | 270/55 |
| 5,082,256 | A | * | 1/1992 | Bryson | 270/55 |
| 5,104,108 | A | * | 4/1992 | Honegger | 270/55 |
| 5,213,318 | A | * | 5/1993 | Newhall | 270/55 |
| 5,527,025 | A | * | 6/1996 | Schlough | 198/803.11 |
| 5,788,446 | A | * | 8/1998 | Stolz | 412/9 |
| 5,921,538 | A | * | 7/1999 | Schlough | 270/52.18 |
| 6,213,457 | B1 | * | 4/2001 | Schlough | 270/52.14 |

* cited by examiner

*Primary Examiner*—A. L. Wellington
*Assistant Examiner*—Monica S. Carter
(74) *Attorney, Agent, or Firm*—Davidson, Davidson & Kappel, LLC

(57) ABSTRACT

A method for preparing a book spine comprises delivering a plurality of products against a spine stop so as to define a spine, the plurality of products contacting a wall having a first section and a second section. The spine stop is moved away from the spine and the printed products are bent by moving the second section pivotally with respect to the first section. Also disclosed is device for preparing a book spine comprising a plurality of pockets, each pocket having a wall having a first section and a second section, the second section being pivotal with respect to the first section. Each pocket further includes a packer and a spine stop removably located at a lower end of the second section for contacting a spine end of the products, the second section and the packer supporting the products for pivotal movement.

17 Claims, 2 Drawing Sheets

DEVICE AND METHOD FOR PREPARING A BOOK SPINE FOR BINDING

BACKGROUND OF THE INVENTION

1. Field of the Invention

The present invention relates generally to book binding and more particularly to a device and method for preparing a book spine for binding.

2. Background Information

To form books (defined herein to include all sheet and signature assemblages), sheets or signatures typically are collated or assembled so that the sheets of the book are arranged in the desired order. U.S. Pat. No. 4,988,086 discloses, for example, an apparatus and method for forming sheet material assemblages. The sheets or signatures are stacked above continuously moving assemblers or pockets and dropped one-by-one into the pockets. The bottom of the pocket can open to release an assembled, but unbound, book.

To prepare books for binding, the sheets or signatures must then be registered, so that all edges are even. The spine will be flat if a flatback book is to be formed. If signatures rather than individual sheets are collated, the backbone of the book typically will be sawed so that individual sheets within each signature present themselves at the spine.

U.S. Pat. Nos. 4,925,354 and 4,556,353 disclose methods for applying an adhesive to the spine of a book. The book is gripped from the top by clamps to expose the spine of the book. The spine of the book has a length greater than a width of the spine, and is flat. As the spine travels in a direction parallel to the length of the spine, an adhesive is applied by rollers or applicators.

The above-referenced patents have the disadvantage that several separate devices are require to collate, register and bind the books. Moreover, transfer of the books between the collating machines, registering machines and the clamps is required. Each transfer point increases the chances for malfunction or a reduction in quality, such as bent edges or misalignment of the pages.

Moreover, transporting the book parallel to the spine length results in high linear velocities. The clamping mechanism must be substantial to hold the book, especially if the backbone is to be cut. The time for the glue to set is also limited, in that it is impractical with high velocities to provide a track having a long enough length for a clamping system to hold the book before the book must be delivered from the clamp.

BRIEF SUMMARY OF THE INVENTION

An object of the present invention is to provide a method and device for preparing a book spine for binding, with the device and the method providing improved register characteristics. Another alternate or additional object of the present invention is to provide an angled book spine. Yet another alternate or additional object of the present invention is to permit for more efficient binding of the book spine.

The present invention provides a method for preparing a book spine including delivering a plurality of products against a spine stop so as to form a book spine, the plurality of products contacting a hinged wall. The hinged wall has a first section and a second section separated by a pivot. The spine stop is then moved away from the book spine, and the printed products are bent about the pivot. "Products" as defined herein may include sheets and/or signatures.

The bending preferably occurs by holding a lower section of the products firmly between the second section of the hinged wall and a packer, and then rotating the second section about the pivot. A skew clamp then preferably holds an upper section of the products against the first section of the hinged wall, the packer is released, and the second section may returned in the direction of its original position.

As a result, the products move downwardly with respect to the hinged wall, thus providing an increased clearance between the book spine and the edge of the hinged wall. Moreover, a skew occurs for all the products, so that an angled spine results. Advantageously, the angled spine allows for improved application of a glue to bind the book. The skew angle preferably is between zero and thirty degrees.

Once the second section is returned to its original position, the packer may again press the book against the second section of the hinged wall and clamp the book for gluing. Minor adjustments to the angle of the spine can be made by moving the second section and the packer.

A glue wheel, advantageously having an axis of rotation perpendicular to the direction of travel of the book, may then apply glue to the spine. Advantageously, the products may travel in a direction perpendicular to the length of the spine while the spine is glued. The spine angle preferably is such that the spine edge is parallel to the direction of travel and tangent to the glue wheel. The glue wheel, which can rotate so as to apply glue in the same direction as the book travel direction, applies the glue to the spine. The tangential velocity of the glue wheel preferably is about the same (within +/−5%) as the velocity of the books.

If water based, the glue can be dried by drying equipment to shorten the setting time.

To deliver the books the packer is opened and the books may fall by gravity to a conveyor or may be removed by a gripper conveyor.

When used with signatures, the present method preferably includes press-pasted signatures so as not to require the use of sawing or roughing of the backbone before gluing. However, it is conceivable that the present invention could also include a sawing step to shape angled spines.

The present invention also includes a device for preparing a book spine comprising a plurality of pockets, each pocket having a wall having a first section and a second section, the second section being pivotally connected to the first section. Each pocket also has a packer and a spine stop removably located at a lower end of the second section for contacting a spine end of products, the wall and the packer supporting the products for pivotal movement.

The pivotal movement of the products and the wall permits for the products to move downwardly with respect to the pocket and also permits skew angles to be formed in the products.

The pockets preferably move in a direction perpendicular to the spine, and in a horizontal plane.

The packer holds a lower part of the products against the second section. A skew clamp is provided for each pocket for holding an upper part of the products as the second section returns to an original position.

A glue wheel having an axis perpendicular to the motion of travel of the books may be provided. The axis preferably is in a horizontal plane.

The various moving parts of the pocket may be controlled by motors or by cam action.

When receiving new products, the side wall and the spine stop preferably form an angle with the vertical plane. Once the products are clamped by the packer and the spine stop is removed, the second section is then movable from the angled position to a vertical position. After the skew clamp is set, the packer may be removed and the second section returned to the angled position.

The present invention also provides a method for gluing a spine of a book comprising the steps of creating an angled spine, moving the angled spine in a direction of travel, the spine length being perpendicular to the direction of travel, and applying glue to the angled spine.

"Book" as defined herein can mean any type of sheet or signature assemblage, including but not limited to, covered printed products, paper booklets, and magazines.

BRIEF DESCRIPTION OF THE DRAWINGS

A preferred embodiment of the present invention is described below by reference to the following drawings, in which.

DETAILED DESCRIPTION

Figure 1:
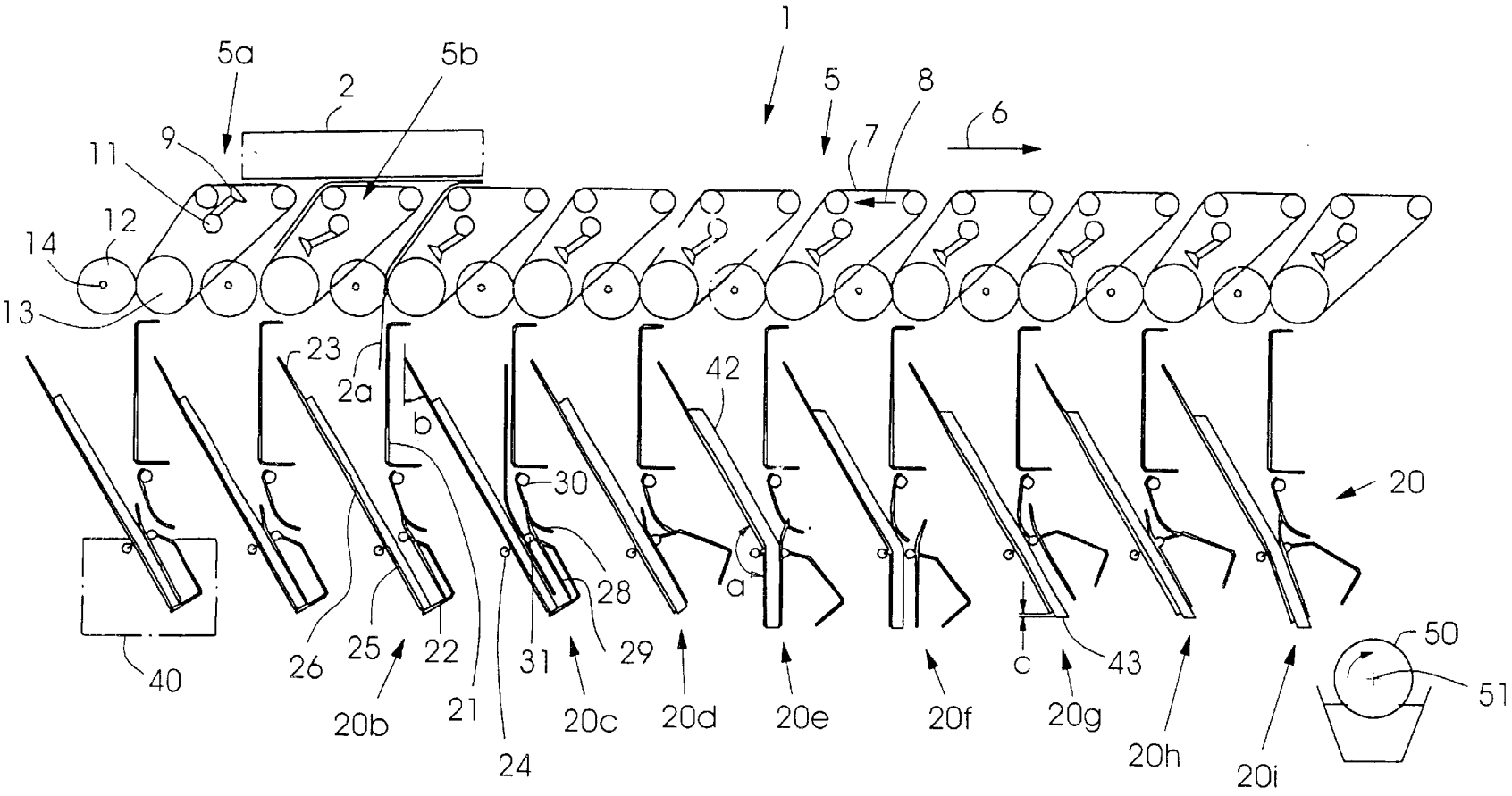
FIG. 1 shows a side view of the device for preparing a book spine according to the present invention.

FIG. 1 shows a side view of the device 1 for preparing a book spine according to the present invention. A stack 2 of signatures sits above a plurality of compilers 5 which move in a direction 6. Each compiler 5 has a belt 7 which runs in a counterclockwise direction 8 so that a top part of the belt has a velocity with a magnitude similar to that of the compilers 5 in direction 6. Stack of signatures 2 thus experiences a relative velocity of zero and remains in the position shown in FIG. 1 as compilers 5 move in direction 6.

Each compiler 5 also includes a pivotable suction device 9, for example a vacuum sucker pivotable about a pivot 11. An eccentrically-mounted caliper roller 12, mounted eccentrically about a shaft 14 moves against or releases from a drive roller 13 for belt 7 depending on an angle of shaft 14. Shaft 14 can be spring-loaded in a closed position.

As compilers 5 travel beneath stack 2, suction device 9 of a compiler 5B pulls a bottom signature of the stack of signature downwardly to pass between compilers 5A and 5B. Caliper roller 12 of compiler 5B opens (through a rotation of shaft 14 against the spring force) to permit the lead edge of the signature to enter between the caliper roller 12 and belt 7 on drive roller 13. The caliper roller 12 then can close by spring force to allow a physical measurement of the thickness of the signature being fed to the compiler, for example, by measuring the angle of shaft 14 in the closed position of caliper roller 12. Caliper roller 12 then may rotate while contacting the signature so that the signature travels between the belt 7 and caliper roller 12 as the signature is further transported.

The signature thus is ready to enter one of a plurality of pockets 20, which travel along with compilers 5 in direction 6. Pockets 20 include a guide 21, a hinged wall 23 and a stop 22. Stop 22 is supported rotationally by a rotatable axle 31. Stop 22 can be rotated by a cam follower arm on one side of stop 22 which can be activated by a stationary cam. However, a motor or other actuating device for rotating axle 31 alternatively could be provided. Hinged wall 23 includes a first wall section 26 and a second wall section 25. The first and second wall sections 26, 25 of pockets 20 are connected by a hinge or pivot 24, which can force the first and second wall sections 26, 25 to be in the same plane through a spring force.

Compilers 5 and pockets 20 may be attached at one or both sides to supports which move along an endless track, for example in a loop. Each support may be, for example, a metal sheet hanging from the track and supporting one of the compilers 5 and one of the pockets 20. Thus, for example, first wall section 26 and guide 21 may be fixedly supported on the support, while axle 31 and shaft 14 may be rotationally supported on the support.

Each pocket also includes a packer or packer 29 and a skew clamp 28, which is rotatably supported about an axle 30. Axle 30 can be driven by a motor or other actuating device supported on the support.

Packer 29 preferably moves using two cam arms actuated by two cam followers. However, a motor actuated packer 29 also is shown in more detail in FIG. 2. In this embodiment, packer 29 may be controlled by two actuating devices 38, 39 which connect to the packer 29 at pivots 140, 41, respectively. Actuating devices 38, 39 can operate independently against support 50 to both translate and rotate packer 29 as will be described. Packer 29 and stop 22 may be axially separated so that they can pass by one another, for example by having two stops 22 at the sides of each edge of the signature and packer 29 operating on the middle of the signature. Skew clamp 28 can also act axially separated from packer 29 and stop 22, for example between the stops 22 and packer 29 so as not interfere with the movements of packer 29 and stop 22.

Figure 2:
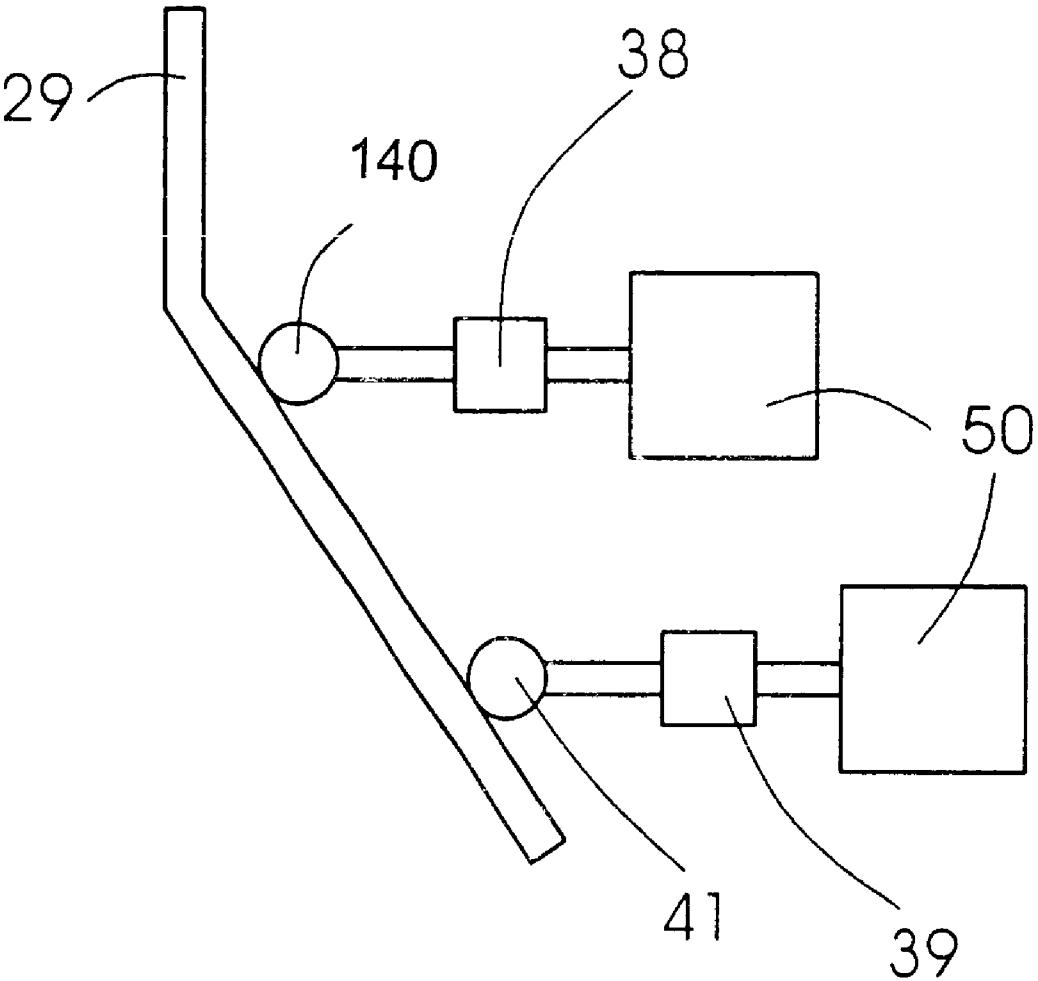
FIG. 2 shows details of the packer of FIG. 1.

As shown in FIG. 1, as a signature 2A enters pocket 20B, packer 29 of pocket 20B opens by a translational retraction movement of both actuating devices 38, 39 (FIG. 2). Once the signature enters the pocket, the signature rests against stop 22. At this time, a side jogger, shown representatively by number 40 although actually much smaller, can be activated to ensure that the side edges of the signatures in the pocket align. Each pocket may have a side jogger 40 supported by the supports on the side of the pocket.

Packer 29 then is closed by a translation movement of both actuating devices 38, 39 (FIG. 2) so that the signatures are gripped for pocket 20C. Stop 22 is then retracted by a rotational movement of axle 30, as shown for pocket 20D. The product is held by the packer 29 and hinged wall 23.

Products 42 are then bent by packer 29 being actuated on its lower end by actuating device 39, as shown with pocket 20E. The spring force at hinge 24 is overcome by the force of packer 29, so that section 25 and products 42 rotate about pivot 24. As shown, this movement causes the product to skew, since the signatures or sheets near the packer 29 are pulled downwardly more than the signatures or sheets near the wall section 25. A latch can hold hinged wall section 25 in a vertical position.

Alternate to the spring and latch mechanism, the movement of section 25 can have a separate cam follower arm which controls the position of section 25 about a pivot 24 through interaction with a stationary cam.

Skew clamp 28 then is activated to firmly hold the products above the bend and preserve the skew, and the packer 29 is released by a translational retraction movement of actuating devices 38, 39, as shown with pocket 20F. Packer 29 can then be rotated by a retraction of actuating device, and the latch for hinged wall section 25 released, so that hinged wall section 25 returns to be coplanar with wall section 26, as shown with pocket 20G.

Alternate to the actuating devices shown with packer 29 in FIG. 2, packer 29 can be actuated by two cam follower arms which interact with stationary cams.

Advantageously, a clearance c between the edge of the products and the wall 23 is created or increased, which can permit for better gluing or processing of the spine 43 without interference by the pockets 20. Moreover, spine 43 obtains a skew, which may be for example generally horizontal.

As shown with pocket 20H, packer 29 may be returned to clamp the products 42 again, and skew clamp 28 retracted. Packer 29 may be slightly rotated to adjust the angle of the spine 43, as shown with pocket 20I. A glue wheel 50, preferably having a tangential velocity about the same as the velocity of the pockets 20 in direction 6, then can apply glue to the spine 43. Advantageously, a rotational axis 51 of wheel 50 is perpendicular to the direction of movement 6.

If the glue is water-based the books can be transported past drying equipment to shorten the setting time. To deliver the books, the packer 29 is opened and the books fall by gravity onto a conveyor or are removed by a gripping device.

It should be understood that typically a plurality of stacks 2 will sit above the moving compilers 5 and pockets 20 to form the book. The signatures may be aided in maintaining a stationary position by a hopper structure having an open bottom.

"Wall" as defined herein may include a solid or non-solid structure, for example, spaced-apart fingers. Moreover, the first and second sections need not contact each other to form a wall, but only must be pivotal with respect to one another.

The angle a of the bend in wall 26 may be for example about 150 to 175 degrees, so that a skew of about 15 to 30 degrees results. The angle b between the vertical and the wall also may be for example about 15 to 30 degrees.

The motions of the moving parts of the device 1 can be cam-activated rather than motor-driven.

The stop 22 when in position to stop the signatures or sheets preferably is at an angle of 90 degrees to the side wall 23. Other angles may cause the spine edges of the products to slide under one another.

The wall section 25 also could be moved by a motor about pivot 24, rather than being spring and latch-controlled.

What is claimed is:

1. A method for preparing a book spine comprising:

delivering a plurality of products into a pocket against a spine stop so as to define a spine, the pocket including a hinged wall including a first wall section and a second wall section;

moving the spine stop away from the spine; and bending the products by moving the second wall section pivotally with respect to the first wall section.

2. The method as recited in claim 1 wherein the bending step includes holding a lower section of the products between the second wall section and a packer, and rotating the second wall section about a pivot.

3. The method as recited in claim 2 further comprising holding an upper section of the products against the first wall section.

4. The method as recited in claim 3 further comprising releasing the packer and returning the second wall section to a position coplanar with the first wall section.

5. The method as recited in claim 1 wherein a resulting skew angle of the products is between zero and thirty degrees.

6. The method as recited in claim 4 wherein after the returning step the packer is pressed against the products.

7. The method as recited in claim 2 further including adjusting an angle of the spine with the packer.

8. The method as recited in claim 1 further including gluing the spine with a glue wheel, the glue wheel rotating about an axis perpendicular to a width of the products.

9. The method as recited in claim 1 wherein the delivery includes moving a plurality of compilers beneath a signature stack, the compilers including moving belts.

10. A device for preparing a book spine comprising:

a plurality of pockets, each pocket having a hinged wall having a first section and a second section, the second section being pivotal with respect to the first section, each pocket further including a packer and a spine stop removably located at a lower end of the second section for contacting a spine end of the products, the second section and the packer supporting the products for pivotal movement.

11. The device as recited in claim 10 further comprising a plurality of compilers above the pockets, the compilers including rotating belts for transferring products to the pockets.

12. The device as recited in claim 10 wherein the pockets are movable in a first direction.

13. The device as recited in claim 10 further comprising a glue wheel having an axis of rotation perpendicular to a width of the products.

14. The device as recited in claim 10 wherein each pocket further comprises a skew clamp for holding an upper part of the products against the first section.

15. The device as recited in claim 10 wherein the wall and the spine stop form an angle with the vertical plane when the products enter one of the pockets.

16. The device as recited in claim 10 wherein the spine stop and the wall form a ninety degree angle to one another as the products enter one of the pockets.

17. A method for gluing a spine of a book comprising:

placing products in a pocket so as to form a flat spine;

creating an angled spine by bending the products;

moving the angled spine in a direction of travel, the spine length being perpendicular to the direction of travel; and applying glue to the angled spine.

* * * * *